US009077136B2

(12) United States Patent
Yang

(10) Patent No.: US 9,077,136 B2
(45) Date of Patent: Jul. 7, 2015

(54) COMBINATION ELECTRICAL CONNECTOR AND ASSEMBLY OF THE SAME

(71) Applicant: Hon Hai Precision Industry Co., Ltd., New Taipei (TW)

(72) Inventor: Wen-Hui Yang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 140 days.

(21) Appl. No.: 13/863,382

(22) Filed: Apr. 16, 2013

(65) Prior Publication Data

US 2013/0273774 A1 Oct. 17, 2013

(30) Foreign Application Priority Data

Apr. 16, 2012 (TW) ..... 101113378 A

(51) Int. Cl.
*H01R 13/6581* (2011.01)
*H01R 43/20* (2006.01)
*H01R 13/504* (2006.01)

(52) U.S. Cl.
CPC ..... *H01R 43/20* (2013.01); *H01R 13/6581* (2013.01); *H01R 13/5045* (2013.01)

(58) Field of Classification Search
CPC . H01R 43/20; H01R 13/5045; H01R 13/6581
USPC ..... 439/540.1, 541.5, 607.58, 660
See application file for complete search history.

(56) References Cited

U.S. PATENT DOCUMENTS

| | | | | |
|---|---|---|---|---|
| 6,174,198 | B1 * | 1/2001 | Wu et al. | 439/541.5 |
| 6,250,958 | B1 * | 6/2001 | Hsish | 439/541.5 |
| 6,331,122 | B1 * | 12/2001 | Wu | 439/567 |
| 6,688,913 | B2 * | 2/2004 | Li | 439/541.5 |
| 6,976,870 | B1 * | 12/2005 | Li | 439/541.5 |
| 7,473,136 | B2 * | 1/2009 | Hu et al. | 439/607.01 |
| 7,578,705 | B2 * | 8/2009 | He et al. | 439/660 |
| 7,857,638 | B2 * | 12/2010 | Zhu | 439/78 |
| 7,946,887 | B1 | 5/2011 | Zhang et al. | |
| 8,210,874 | B2 | 7/2012 | Zhang et al. | |
| 2010/0151727 | A1 * | 6/2010 | Luo et al. | 439/544 |
| 2011/0104946 | A1 * | 5/2011 | Zhang | 439/607.01 |

* cited by examiner

*Primary Examiner* — Briggitte R Hammond
(74) *Attorney, Agent, or Firm* — Wei Te Chung; Ming Chieh Chang

(57) ABSTRACT

An electrical connector comprises an insulating housing, a contact module and a metal shell. The insulating housing defines a front face and rear face, and a receiving space running through the front face and the rear face. The contact module includes a plurality of first contacts loaded thereon and is received in the receiving space, the contacting comprising board connecting tail exposing to the rear face of the housing. The metal shell is received in the receiving space and surrounds the contact module second connector port located beside and separated from the first connector port in said lengthwise direction. Wherein the metal shell is inserted and retained with the insulating housing from the front face, the contact module is inserted and retained with the insulating housing from the rear face.

19 Claims, 7 Drawing Sheets

COMBINATION ELECTRICAL CONNECTOR AND ASSEMBLY OF THE SAME

BACKGROUND OF THE INVENTION

1. Field of the Invention

The present invention relates to a combination electrical connector, and more particularly to a USB connector with an insulating shielding frame.

2. Description of Prior Art

Taiwan Utility Patent Issue No. M399522 discloses an electrical connector including a contact module and a metal shell outside. The metal shell is used to shield the contact module and protect the contact module from electromagnetic interference. As known, the metal shell is served as an outermost periphery with no protected member during its disposition in the air.

Thus, there is a need to provide an improved electrical connector to overcome the above-mentioned problems.

SUMMARY OF THE INVENTION

An object of the present invention is provide an electrical connector with better assembling process.

In order to achieve the object, an electrical connector comprises an insulating housing, a contact module and a metal shell. The insulating housing defines a front face and rear face, and a receiving space running through the front face and the rear face. The contact module includes a plurality of first contacts loaded thereon and is received in the receiving space, the contacting comprising board connecting tail exposing to the rear face of the housing. The metal shell is received in the receiving space and surrounds the contact module second connector port located beside and separated from the first connector port in said lengthwise direction. Wherein the metal shell is inserted and retained with the insulating housing from the front face, the contact module is inserted and retained with the insulating housing from the rear face.

BRIEF DESCRIPTION OF THE DRAWINGS

Other objects, advantages and novel features of the present invention will become more apparent from the following detailed description when taken in conjunction with the accompanying drawings, in which.

DESCRIPTION OF PREFERRED EMBODIMENT

Figure 1:
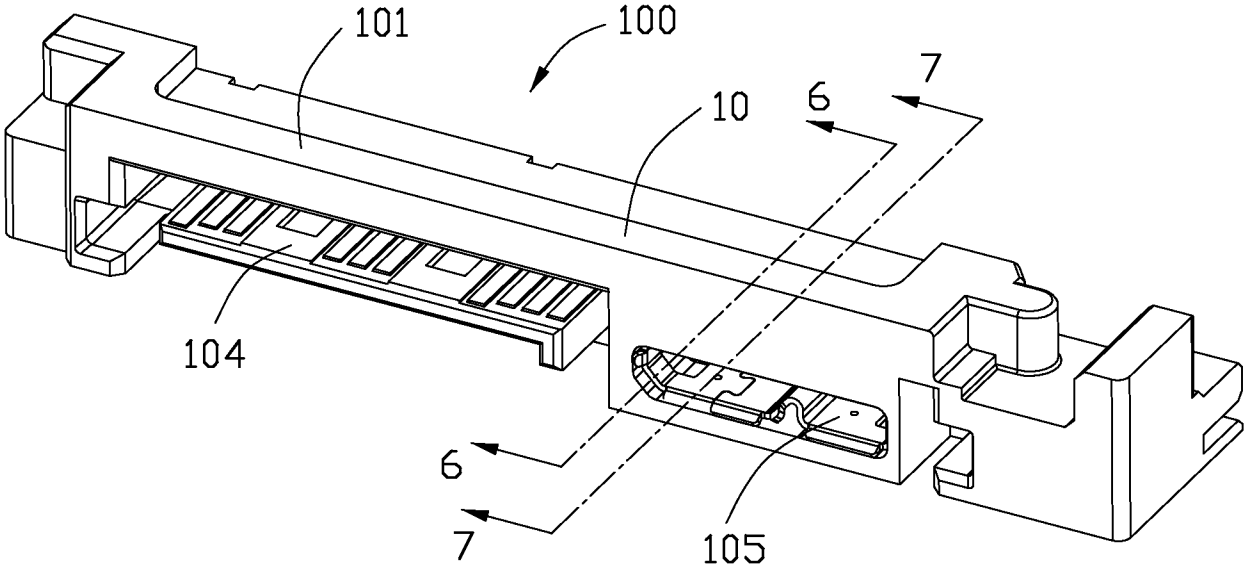
FIG. 1 is a perspective view of an electrical connector in accordance with a preferred embodiment of the present invention, from a front view.

Reference will be made to the drawing figures to describe the present invention in detail, wherein depicted elements are not necessarily shown to scale and wherein like or similar elements are designated by same or similar reference numeral through the several views and same or similar terminology.

Figure 2:
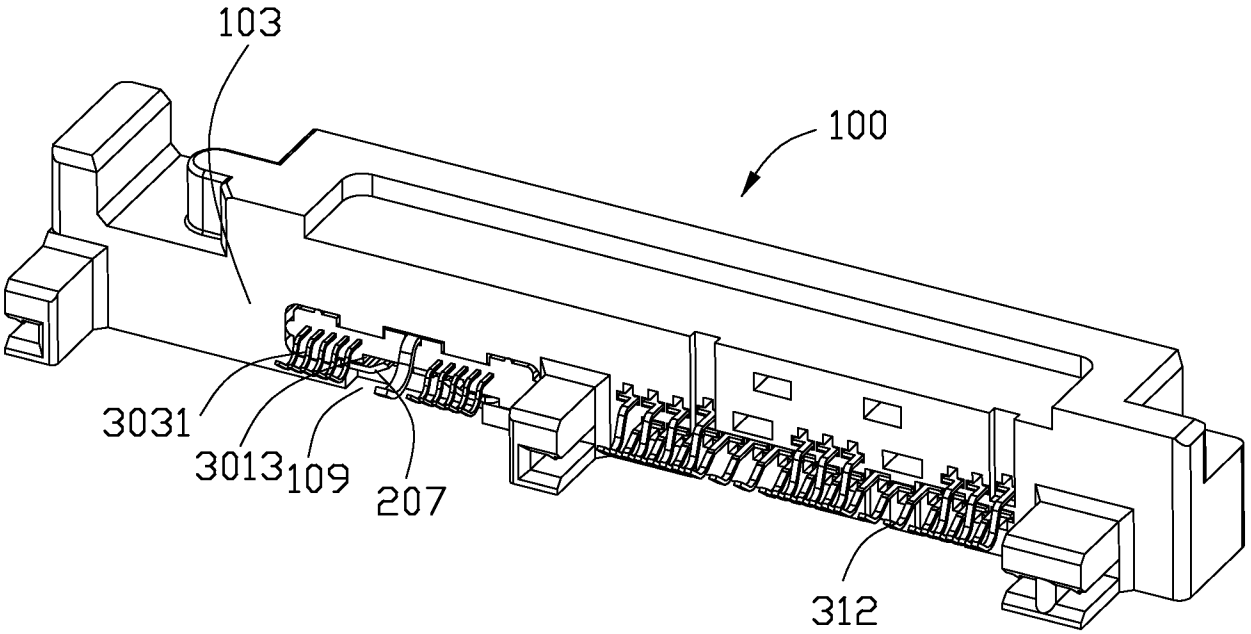
FIG. 2 is a perspective view of the electrical connector from a rear view.
Figure 3:
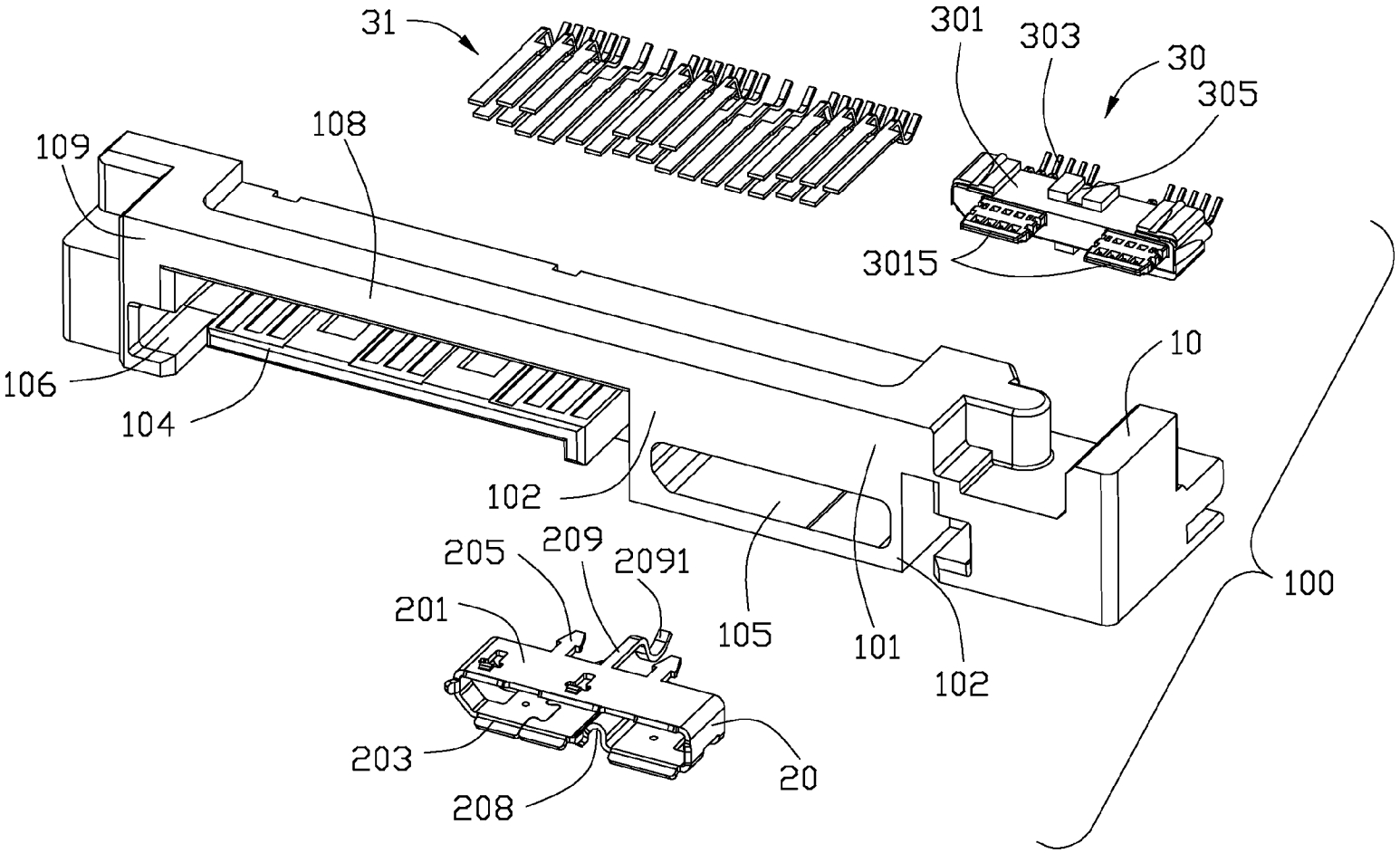
FIG. 3 is an exploded perspective view of the electrical connector shown in FIG. 1.

Referring to FIGS. 1 to 3, the present invention relates to a combo electrical connector 100 including a whole Micro USB interface and a power segment of a SATA interface arranged in a lengthwise direction of the connector. The electrical connector 100 comprises an elongated insulating housing 10, a contact module 30 with first contacts 303 and a group of second contacts 31 in the housing, and a metal shell 20 attached to the insulating housing 10.

Figure 4:
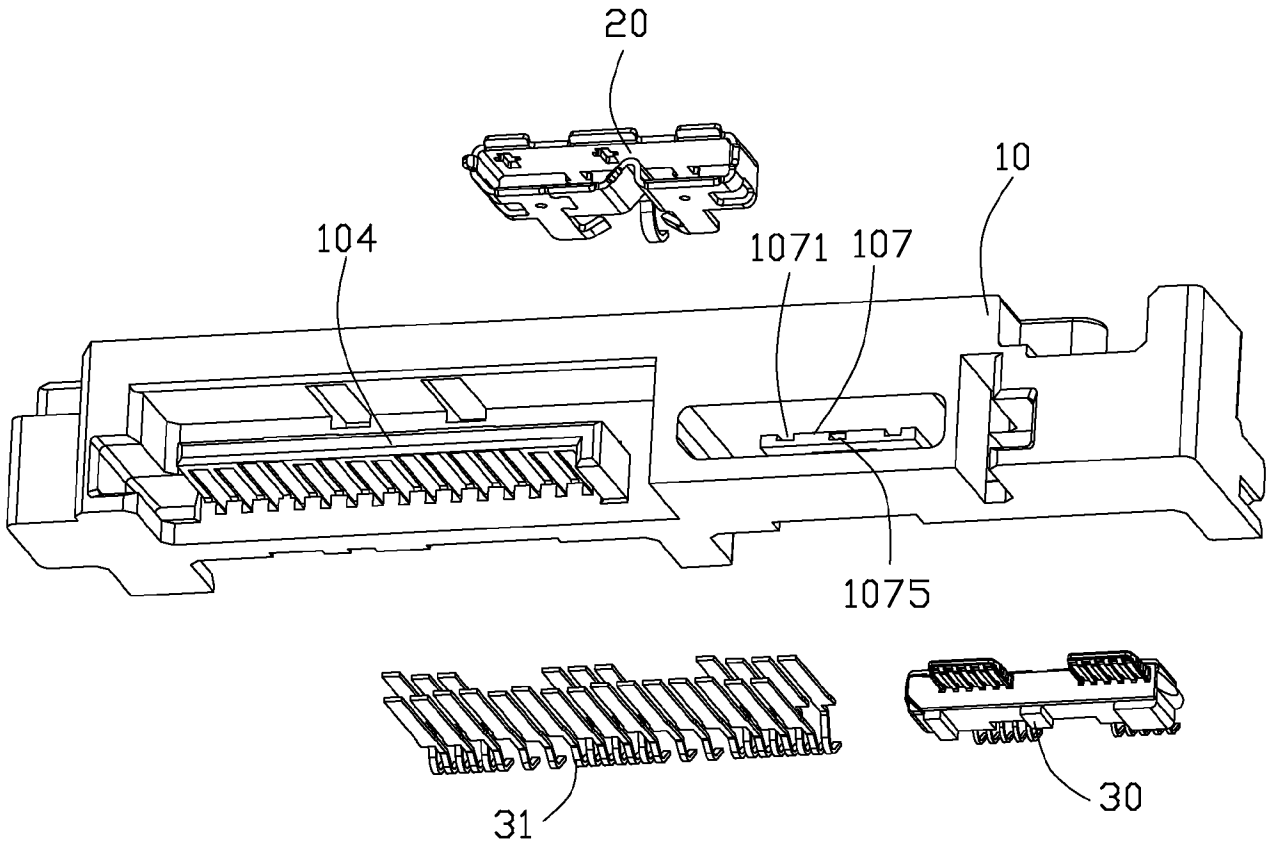
FIG. 4 is an exploded perspective view of the electrical connector shown in FIG. 1 from another view.
Figure 5:
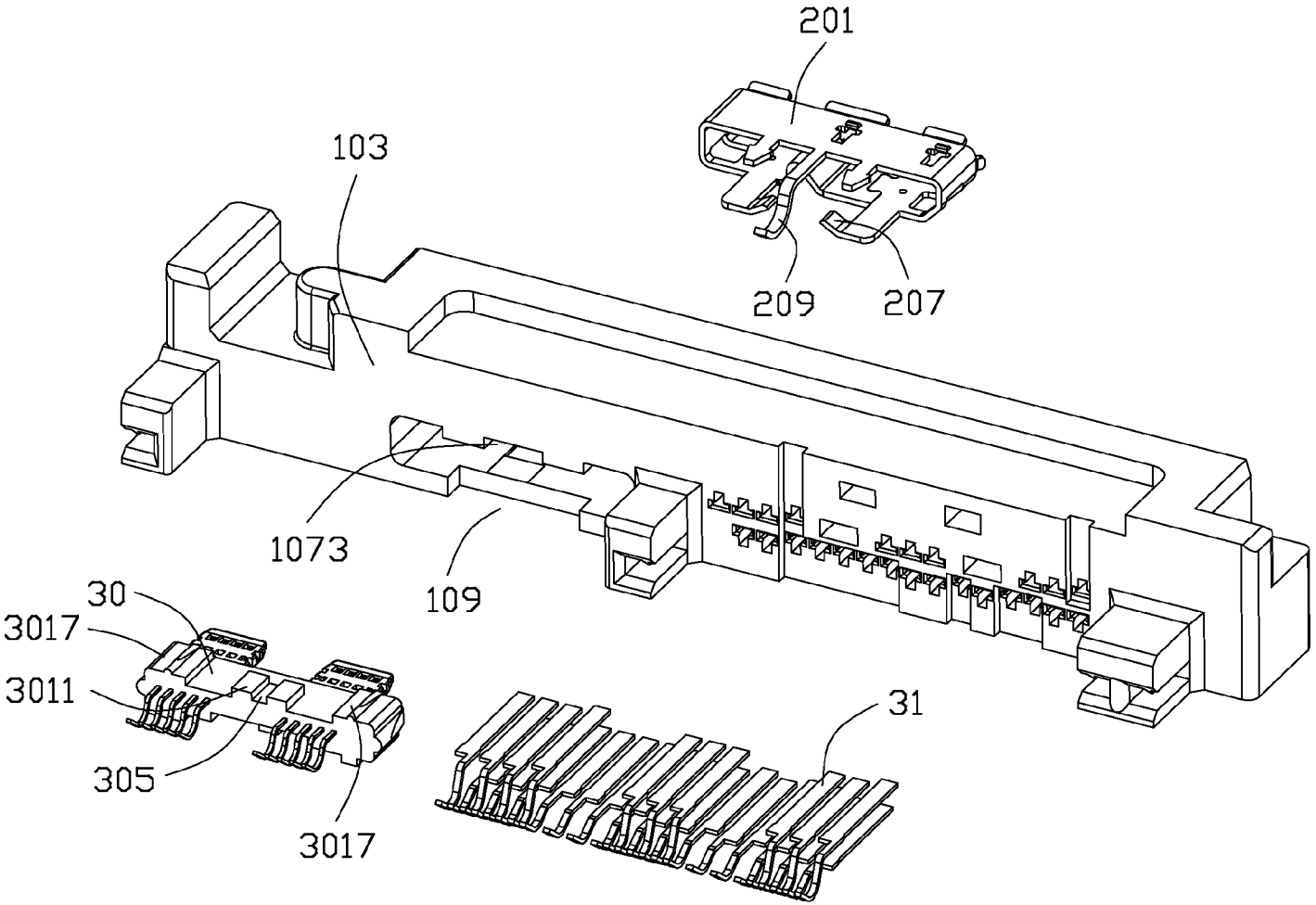
FIG. 5 is an exploded perspective view of the electrical connector shown in FIG. 2.

Referring to FIGS. 3 to 5, the insulating housing 10 defines a front face 101, a back face 103, an L-shaped tongue 104 between the front face and the back face and a frame 102 with a receiving space 105 running through the front face and the back face. A pair of end walls 107 is disposed at opposite ends of the L-shaped tongue 104 and the frame 102 along the lengthwise direction, each end wall 107 defining a guiding slot 106 facing to the L-shaped tongue 104. A protecting wall 108 is integrally formed with the end walls 107, which is parallel to the L-shaped tongue 104 to shield the L-shaped tongue 104 at the upside. The frame 102 is integrally formed with the protecting wall 108 without any gap to enhance intensity of the housing. The group of second contacts 31 is arranged at opposite faces of the L-shaped tongue 104.

Figure 6:
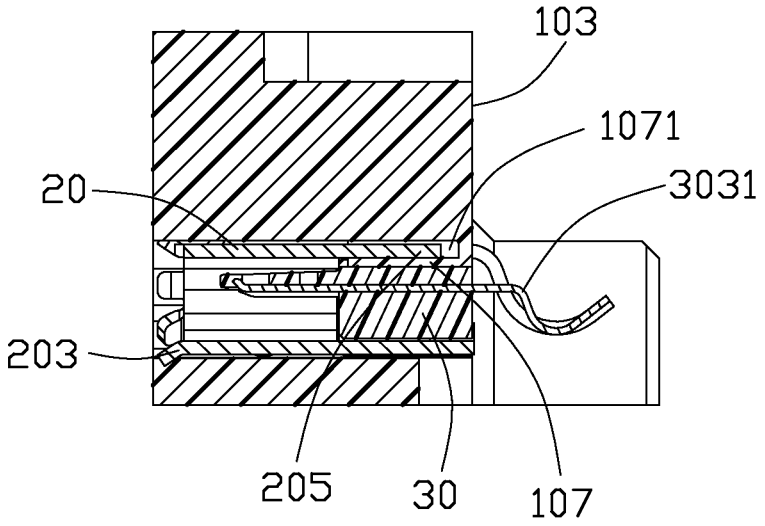
FIG. 6 is a cross-sectional view of the electrical connector shown in FIG. 1 along lines 6-6.
Figure 7:
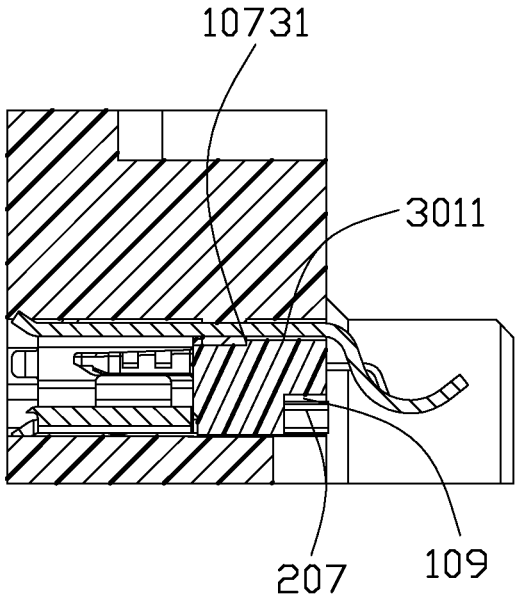
FIG. 7 is a cross-sectional view of the electrical connector shown in FIG. 1 along lines 7-7.

The insulating housing 10 includes a supporting plate 107 integrally extending forward into the receiving space 107, with two forward-opening first slot 1071 running through a front face of the supporting plate 107 and a rear-recessed second slot 1073 recessed from the back face 103 with a front stopping face 10731 as shown in FIG. 7. Said shell 20 comprises a frame wall 201 which is received in the receiving space 105 and several smooth flanges 203 extending from front edges the frame wall 201 and exposing to the front end of the insulating housing 10. The frame wall 201 has a pair of fixing lugs 205 extending from a rear edge of a top wall thereof and a pair of stopping lugs 207 extending rearward from the rear edge of a lower wall. The fixing lugs 205 are retained in first slot 1071 as best shown in FIG. 6 and the stopping lugs 207 are retained in a recess 3013 when the shell 20 is inserted in the receiving space 105. Understandably, both the fixing lugs 205 and the stopping lugs 207 are essentially the so-called fastening lugs. An grounding arm 209 extends from the rear edge of the shell 20 between said two fixing lugs 205 with an arc free end 2091, which extends and exposes to the back face 103 of the housing. The supporting plate 107 defines a third slot 1075 through which said grounding arm extends.

The contact module 30 comprises an insulating base 301 and a plurality of said first contacts 303 retained on the insulating base thereby defining the Micro USB 3.0 interface. The contacts 303 are inserted molding with the insulating base 301 with tails 3031 protruding from the back face 103. The contact module 30 (or the insulating base 301) includes a stopping portion 3011 at a top face thereof, the stopping portion 3011 has a smaller dimension in a mating direction perpendicular to the lengthwise direction than the base or other retaining portions 3017 interfering with housing for retention. The contact module 30 defines said recess 3013 shown in FIG. 2 at the rear face thereof. The stopping lugs 207 are planar before the shell is inserted to the housing and the stopping lugs 207 are bended in the recess 3013 after the shell 20 is assembled to the insulating housing 10, thereby preventing the shell 20 from escaping from the insulating housing 10. Referring to FIG. 3 in this embodiment, the insulating base 301 includes two smaller tongues 3015 to retain said first contacts 303. The shell 20 surrounds the two tongues 3015 to define said Micro USB 3.0 port and has an arc rib 208 between the two smaller tongues for anti-mismating. The smooth flanges are located at the front face 101 to guide a mating connector (not shown).

Combination with FIGS. 6 and 7, assembling process of the combo electrical connector 100 is shown. The shell 20 is inserted into receiving space 105 of the housing 10 from the front face 101. The fixing lugs 205 are inserted and then retained the slots 1071. The stopping lugs 207 expose to the rear face 103 of the housing. Then, the contact module 30 is inserted into the shell 30 from the back face 103 until the stopping portions 3011 are completely received in the second slot 1073. The supporting plate 107 is shaped as a "U" (not shown) by second slot 1073. The stopping portion is limited by the supporting plate and can not move forward or longitudinally anymore. The stopping portion 3011 is provided with a through slot 305 in the mating direction. The grounding arm 209 can just go through the through slot 305 to allow an insertion of the contacting module 30. The contact module 30 is interfered with housing to be retained in the receiving space 105, the retaining portions 3017 provide great force. The stopping lugs 207 are then bend by a toll, into the recess 3013. In this embodiment, a cavity 109 is defined at the rear face 105 for the toll. Lastly, the first and second contacts and the shell 20 are bended to form board connecting tails 303, 2091, 312. The shell 20 and the contact module 30 are assembled from opposite directions (both parallel to the mating direction), forming a stable Micro USB 3.0 interface with a balance both structural and mechanical.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulating housing defining a front face and a rear face, and a receiving space running through the front face and the rear face;

a contact module with a plurality of first contacts loaded thereon, the contact module being received in the receiving space, the each first contact comprising a board connecting tail exposed to the rear face of the housing;

a metal shell received in the receiving space and surrounding the contact module;

wherein the insulating housing and the metal shell are configured to allow the metal shell be inserted and retained with the insulating housing only from the front face; the contact module and the insulating housing are configured to allow the contact module to be inserted and retained with the insulating housing only from the rear face; wherein the metal shell defines a stopping lug at a rear edge thereof, and the stopping lug is bent into a corresponding recess defined in a rear side of the contact module.

2. The electrical connector as claimed in claim 1, wherein after both the contact module and the shell are assembled to the housing, the stopping lug is bent into the corresponding recess successively.

3. The electrical connector as claimed in claim 1, wherein the receiving space defines a supporting plate integrally therefrom, two forward-opening first slots running through a front face of the supporting plate and a rear-recessed second slot recessed from the rear face of the housing with a front stopping face, two fixing lugs extending from a rear edge of the metal shell and the fixing lugs are retained in the first slot of the supporting plate, the contact module defines a stopping portion and the stopping portion is received in the second slot and press against the front stopping face.

4. The electrical connector as claimed in claim 3, wherein the metal shell defines a grounding arm extending from the rear edge of the metal shell, the stopping portion of the contact module defines a through slot and the grounding arm run through the through slot thereby an arc free end of the grounding arm being aligned with the board connecting tail of the first contacts.

5. The electrical connector as claimed in claim 1, wherein the metal shell defines smooth outward guiding flanges at a front edges thereof, the guiding flanges are hidden in the receiving space.

6. An electrical connector comprising:

an insulative housing defining a receiving space extending therethough in a front-to-back direction, a first stopping portion formed on an interior face of the housing around said receiving space;

a contact module having an insulative body discrete from the housing while being receiving in the receiving space and equipped with contacts therein, a second stopping portion formed on an exterior face of the contact module and forwardly abutting against the first stopping portion;

a frame like metallic shell snugly assembled into the receiving space and surrounding a mating port formed by the contact module; wherein said metallic shell and said housing are configured to allow said metallic shell to be inserted into the receiving space only rearwardly in said front-to-back direction; wherein said contact module includes a mating tongue extending into the mating port and enclosed in the metallic shell.

7. The electrical connector as claimed in claim 6, wherein said metallic shell further defines at least one fastening lug abutting against at least one of said housing or said contact module.

8. The electrical connector as claimed in claim 7, wherein said fastening lug is a stopping lug which forwardly abuts against the contact module to secure the contact module in position.

9. The electrical connector as claimed in claim 7, wherein said fastening lug is a fixing lug interfering within a slot in the housing to secure the metallic shell in position.

10. The electrical connector as claimed in claim 6, wherein said metallic shell further defines a grounding arm extending rearwardly and downwardly to be terminated around a bottom face of the housing.

11. The electrical connector as claimed in claim 10, wherein the first stopping portion defines a slot through which said grounding arm extends.

12. The electrical connector as claimed in claim 10, wherein said second stopping portion defines a slot through which said grounding arm extends.

13. The electrical connector as claimed in claim 6, wherein said metallic shell includes one stopping lug engaged with the contact module, and one fixing lug engaged with the housing.

14. The electrical connector as claimed in claim 13, wherein said stopping lug and said fixing lug are located on two opposite sides of the metallic shell.

15. The electrical connector as claimed in claim 14, wherein said stopping lug and said fixing lug are located on said two opposite sides in a vertical direction perpendicular to said front-to-back direction.

16. The electrical connector as claimed in claim 13, wherein said metallic shell defines a frame wall located in front of a base of the contact module and said mating tongue unitarily extends forwardly from the base.

17. An electrical connector comprising:

an insulative housing defining a receiving space extending therethough in a front-to-back direction, a first stopping portion formed on an interior face of the housing around said receiving space;

a contact module having an insulative body discrete from the housing while being receiving in the receiving space and equipped with contacts therein, a second stopping portion formed on an exterior face of the contact module and forwardly abutting against the first stopping portion; and a frame like metallic shell snugly assembled into the receiving space and surrounding a mating port formed by the contact module; wherein said metallic shell and said housing are configured to allow said metallic shell to be inserted into the receiving space only rearwardly in said front-to-back direction; wherein said metallic shell includes one stopping lug engaged with the contact module, and one fixing lug engaged with the housing.

18. The electrical connector as claimed in claim 17, wherein said housing and said contact module are configured to allow said contact module to only be forwardly assembled to the housing along said front-to-back direction, and said stopping lug forwardly abuts against the contact module for preventing rearward withdrawal of the contact module from the housing.

19. The electrical connector as claimed in claim 18, wherein said stopping lug is received within a recess formed in a rear face of the insulative body.

* * * * *